United States Patent [19]

Senor

[11] 4,224,591

[45] Sep. 23, 1980

[54] MOTOR PROTECTOR WITH METAL HOUSING AND WITH PREFORMED EXTERNAL HEATER THEREON

[75] Inventor: Ronald E. Senor, North Attleboro, Mass.

[73] Assignee: Texas Instruments Incorporated, Dallas, Tex.

[21] Appl. No.: 965,801

[22] Filed: Dec. 4, 1978

[51] Int. Cl.[2] ..... H01H 61/02; H01H 71/02

[52] U.S. Cl. ..... 337/102; 337/112

[58] Field of Search ..... 337/102, 103, 107, 23, 337/77, 100, 120, 182, 324, 377, 112, 113

[56] References Cited

U.S. PATENT DOCUMENTS

| | | | |
|---|---|---|---|
| 3,474,372 | 10/1969 | Davenport et al. | 337/112 |
| 4,086,558 | 4/1978 | Pejouhy et al. | 337/102 |

*Primary Examiner*—Harold Broome

*Attorney, Agent, or Firm*—John A. Haug; James P. McAndrews

[57] ABSTRACT

A motor protector has a thermally responsive contact element mounted inside a flat, rectangular, open-ended metal can. A metal cover mounts a complementary contact and is secured over the open end of the can by can flanges to clamp an electrically insulating gasket between the can and cover. The contact means close a circuit between the can and cover but the thermally responsive contact element is movable in response to increase in temperature for opening that circuit. Integral crimpable terminals are provided on the can and cover. A flat metal heater ribbon having an insulating coating thereon has one end welded to the exterior of the can. The ribbon coating is deformed at selected locations and the coated ribbon is folded at those locations to fit closely against the three exterior sides of the flat rectangular can. The can terminal crimps the opposite end of the coated ribbon in electrically insulated relation to the ribbon for holding the coated ribbon in position on the can. In that way, the heater is adapted for automated assembly on the can to provide consistent uniform heat-transfer to the can. The heater is also disposed to be easily and reliably connected in series with the contact means in a motor circuit for improving the thermal response, cost and service life characteristics of the motor protector.

4 Claims, 4 Drawing Figures

MOTOR PROTECTOR WITH METAL HOUSING AND WITH PREFORMED EXTERNAL HEATER THEREON

In some motor protector systems where consistent mounting of a motor protector in efficient heat-transfer relation to a motor winding cannot be assured, or where prompt anticipation of overheating of a motor winding is desired, an electrical resistance heater is connected in series with the motor winding and is arranged in predetermined heat-transfer relation to the thermally-responsive component of the motor protector. The heater is responsive to the occurrence of the overload or other fault currents in the winding for heating the thermal component of the protector to open the motor circuit before excessive overheating of the motor winding can take place.

In a previously known motor protector of that type as shown in U.S. Pat. No, 4,086,558, the basic protector structure is adapted for automated manufacture and the heater is disposed with a selected orientation on the exterior surface of the basic structure. In that arangement, the basic protector is made at low cost and a heater of desired proportions can be added outside the basic structure to adapt the motor protector for use with motors of various different sizes and ratings. Further, because the heater is mounted externally, it is proportioned to heat the substantial thermal mass of the protector when interrupting the motor circuit in response to the occurrence of an overload or other fault current condition in the motor. The protector then keeps the motor circuit open for a subsantial period of time while the relatively large mass of the protector cools before the protector permits the motor circuit to reclose. That is, the protector cycles only at a relatively slow rate while the fault condition persists so that the protector tends to display a very long service life.

However, it is found that the external heater is difficult to mount on the mass-produced, basic structure of the protector and does not always display uniform heat-transfer to the basic protector structure. Further, connection of the previously known protector in a motor circuit is difficult and somewhat unreliable. Most important, the assembly of the external heater adds significantly to the cost of the otherwise inexpensive motor protector unit.

It is an object of this invention to provide a novel and improved motor protector; to provide such a protector which is readily adapted for protecting motors of different sizes and ratings, which is promptly responsive to the occurrence of fault currents in a motor winding circuit, which displays improved cycle time and service life, and which is particularly useful in protecting motors with relatively low motor current or motors having high rates of temperature rise under fault condition; to provide such a motor protector which is adapted for automated manufacture of the basic protector structure and assembly of a properly proportioned, exteriorly mounted heater on that structure; and to provide such a motor protector having an exteriorly mounted heater which is securely and reliably mounted on the heater for convenient connection in a motor winding circuit.

Other objects, advantages and details of the novel and advantageous motor protector of this invention appear in the following detailed description of preferred embodiments of the invention, the detailed description referring to the drawings in which.

Figure 1:
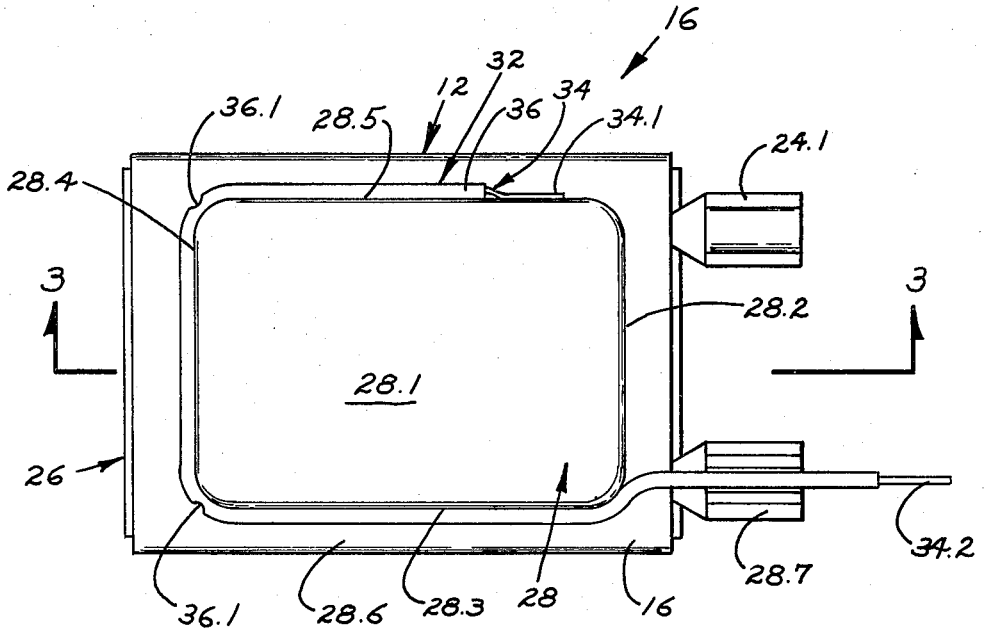
FIG. 1 is a plan view of the motor protector provided by this invention.
Figure 2:
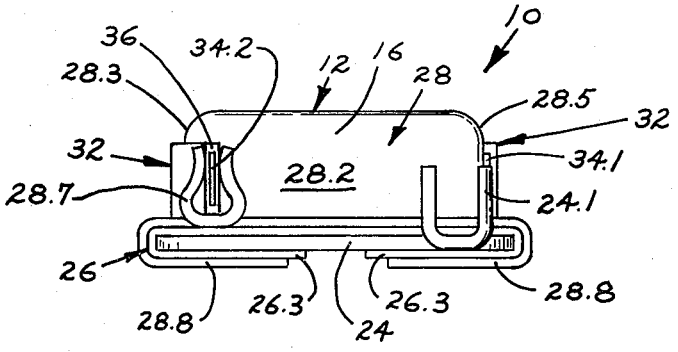
FIG. 2 is an end elevation view of the protector of FIG. 1.

Referring to the drawings, 10 in FIGS. 1-4 indicates the novel and improved protector of this invention which is shown to include a basic motor protector assembly 12 incorporating a fixed electrical contact 14 mounted in a metal housing 16 and a complementary electrical contact 18 movable along an axis (indicated at 22 in FIG. 3) by a thermostatic bimetallic element 20 to engage and disengage the first contact 14 in response to changes in the temperature of the thermostatic element. In a preferred embodiment of this invention, the basic protector assembly 12 is particularly adapted to be mass produced at very low cost and the thermal mass of the housing and electrical contacts embodied in the assembly is large relative to the thermal mass of the thermostatic element in the assembly.

Figure 3:
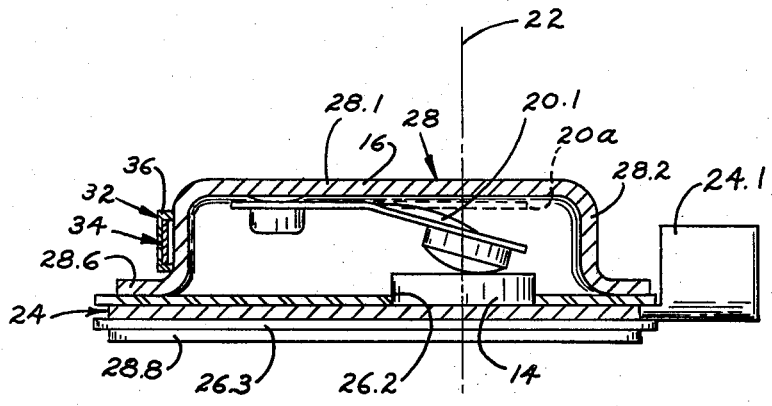
FIG. 3 is a section view along line 3—3 of FIG. 1.
Figure 4:
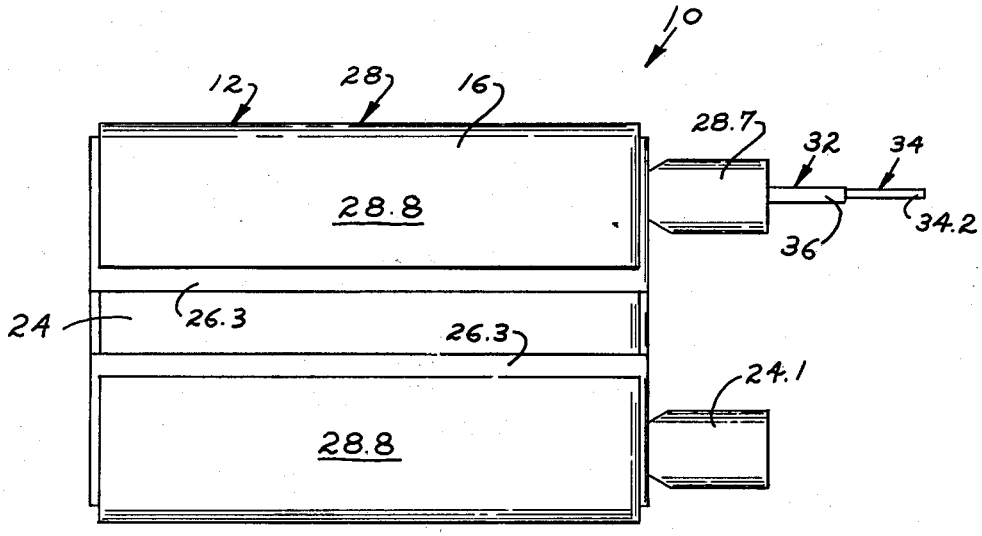
FIG. 4 is a bottom plan view of the device of FIG. 1.

Typically, for example, the basic motor protector assembly 12 corresponds to that shown in U.S. Pat. No. 3,430,177 issued on Feb. 25, 1979 to R. T. Audette. That is, as is illustrated in FIGS. 1-4, the housing 16 of the assembly 12 preferably comprises a flat metal plate 24 having an integral, crimpable terminal sleeve 24.1 at one end of the plate. The first contact 14 is welded to the plate 24 as shown in FIG. 3. A sheet 26 of gasket material has a main portion 26.1 fitted over the plate, has an opening 26.2 in the main portion of the gasket fitted around the contact 14, and has edges 26.3 extending around respective lateral edges of the plate 24. The housing 16 further includes a flat, rectangular, open-ended can member 28 having a bottom 28.1, side walls 28.2, 28.3, 28.4 and 28.5, a flange 28.6 extending from the side walls, an integral, crimpable sleeve terminal 28.7 extending from the flange at one end of the can, and a pair of tabs 28.8 extending from around respective edges 26.3 of the gasket and around the lateral edges of the cover plate 24 to grip and secure the cover plate 24 in sealed, electrically insulated relation to the can. The thermostatic element 20 is welded to the can bottom 28.1 by means of a welding slug 30 to extend in cantilever relation from the can bottom. The movable, complementary contact 18 is welded to the distal end of the element 20 as shown in FIG. 3. As will be understood, the thermostatic element 20 is formed of two layers of metal of different coefficients of thermal expansion and has a dished or non-developable portion 20.1 intermediate its end. With this construction, the element 20 normally holds the movable contact 18 in engagement with the fixed contact 14 to close a circuit between the cover 24 and the can 28. However, when the element is heated to a selected temperature, the element moves, with snap-over-center action of the dished portion thereof, to the disposition indicated by the broken line **20*a* in FIG. 3, thereby to disengage the contacts to open the noted circuit. Typically, the materials of the thermostatic element are selected to provide the element with a desired electrical resistivity so that the element is heated to a selected extent by the flow of electrical current through the element. As the basic assembly 12 is conventional, it is not further described herein and it will be understood that the element 20 is adapted to move with snap-action to disngage the contacts when the element is heated to a first selected temperature and is then adapted to move with snap-action to reengage the contacts when the element subsequently cools to a second, relatively lower, element temperature. Preferably, in a typical embodiment of this invention, the basic protector assembly 12 is about 0.750 inches long, 0.375 inches wide and about 0.187 inches thick. Further, the thermostatic element 20** typically has a mass of approximately 0.05 grams whereas the combined mass of the housing, contacts and other metal components of the assembly is typically on the order of 1.4 grams.

In accordance with this invention, the motor protector 10 includes a heater element 32 having a thin, flat, metal, heater ribbon 34 formed of a nichrome alloy or the like having selected electrical resistance properties. A coating 36 of an electrical insulating material such as tetrofluoroethylene (Teflon) or the like is provided on the ribbon while the ends 34.1 and 34.2 of the ribbon are free of the coating. The ribbon coating is deformed at selected locations 36.1 as indicated in the drawing so that the heater element readily folds at those locations to conform to the three exterior side walls of the flat, rectangular housing can 28 to be mounted in close heat-transfer relation to the can. Preferably for example the resistance heater ribbon 34 is provided in a continuous coil with the coating 36 extruded onto the ribbon in any conventional manner. The heater element 32 is cut from that coil to the desired length and the coating is stripped from the ends 34.1 and 34.2 of the metal ribbon. The coating is also deformed under pressure at two locations 36.1 so that the coated ribbon folds and lays snugly and easily against the three exterior sides 28.3–5 of the housing can. The ribbon end 34.1 is welded to the can side 28.5 as shown at 38 in the drawing so that it is electrically connected to the can and is securely attached to the can. The other end of the heater element is then extended through the can terminal 28.7 which is crimped against the heater element coating for holding the heater in position on the can. That is, the weld of one end end 34.1 of the ribbon to the can locates that end of the ribbon relative to the can so that the heater element readily folds at the location to lay closely against the exterior sides 28.3–5 of the housing can. With the heater element pulled to lay against the can sides, the can terminal 28.7 is crimped to the element coating in electrically insulated relation to the heater ribbon 34. In that way, the terminal 28.7 secures the heater element in its assembled position on the can and disposes the stripped end 34.2 of the heater element in a position to be easily connected in an electrical circuit. In typical embodiments of the invention, the heater ribbon has a thickness of about 0.005 to 0.010 inches and a width of about 0.070 inches and is formed of a nichrome alloy or other material selected to provide the ribbon with a predetermined resistance in the range from about 0.005 to 0.550 ohms as may be desired. The coating 36 has a typical thickness on the order of 0.020 inches at the sides of the ribbon.

In that arrangement, when the cover terminal 24.1 and the end 34.2 of the heater ribbon are connected in series with a motor winding (not shown), the winding current is directed through the heater 32, the can 28, the thermally responsive element 20, the contact 18, the contact 14, the cover 24 and the cover terminal 24.1. When an overload or other excessive fault-condition current flows in the motor winding, heat is generated in the heater 32 for moving the thermally responsive element 20 to open the motor winding circuit as will be understood. Because the heater 32 is in series with the can and cover and the thermally responsive element 20, current flow in all of those components cooperates in generating sufficient heat to actuate the element 20 when an overload current occurs in the motor winding, and, because the heater 32 is externally mounted on the basic protector structure 12, the heater is proportioned to generate a selected amount of heat in response to a predetermined overload current for opening the winding circuit in a desired period of time.

In the protector 10 as above described, the heater coil is oriented with its coil axis parallel to the axis 22 as discussed in U.S. Pat. No. 4,086,558. The heater characteristics are easily modified by providing heater ribbon 34 of various alloys, widths and thicknesses to generate the desired level of heat but the ribbon is adapted to be inexpensively mounted on the basic structure 12 by any of various conventional automated assembly techniques. Mouting of the heater having the noted configuration is adapted to provide consistent heat-transfer to the housing can 28 and to the element 20 within the can. The heater is securely mounted on the can 28 and the terminal 24.1 and the heater end 34.2 are conveniently disposed to be easily and reliably connected in a motor winding circuit.

It should be understood that although particular embodiments of the motor protector 10 are described by way of illustrating this invention, the invention includes all modifications and equivalents of the disclosed embodiments falling within the scope of the appended claims.

I claim:

1. A thermally responsive motor protector comprising a rectilinear metal housing having a body component and a cover component secured together in electrically insulated relation to each other to form an enclosure, thermally responsive means mounted within the enclosure normally closing a circuit between the body and cover and movable when heated to a selected temperature for opening that circuit, and a heater having a flat ribbon of metal of selected electrical resistance properties having a deformable electrically insulating coating covering a central portion of the ribbon, said coating being deformed at selected locations and being folded at said locations for disposing selected portions of the metal ribbon in heat transfer relation to selected rectilinear portions of said housing, said ribbon having one end thereof electrically connected to one of said housing components and having its opposite end disposed to be connected in an electrical circuit.

2. A protector as set forth in claim 1 wherein said housing body comprises a flat, rectangular, open-ended metal can and said heater has one end welded to said can.

3. A protector as set forth in claim 1 wherein said can has integral means supporting the opposite end of said heater.

4. A thermally responsive motor protector comprising a flat, rectangular, open-ended metal housing can having a bottom, four side walls upstanding from the bottom, a flange on the side walls extending around the open end of the can, and an integral crimpable terminal on the flange, a metal cover secured in electrically insulated relation to the can over the open end of the can forming a housing enclosure, the cover having an integral terminal thereon, thermally responsive means mounted within the enclosure normally closing a circuit between the can and cover, the thermally responsive means being movable when heated to a selected temperature for opening said circuit, and electrical resistance heater means mounted exteriorly of the housing enclosure to be connected in series with the can and cover and with a motor winding for heating the thermally responsive means to open said circuit and interrupt current flow in the winding in response to the occurrence of an overload current in the winding, characterized in that the heater comprises a flat ribbon of metal of selected electrical resistance properties having a deformable electrically insulating coating thereon, said coating being deformed at selected locations and being folded at said locations to dispose portions of the heater snugly against receptacle side wall portions of the can in selected, uniform heat-transfer relation to the thermally responsive means within said enclosure, said metal ribbon having one end welded to one of said side walls for securing the ribbon in electrically connected relation to the can and said heater having a coated portion adjacent its opposite end crimped in said can terminal in electrically insulated relation to the can for disposing the opposite end of ribbon to be connected to said motor winding.

* * * * *